US005301991A

United States Patent [19]

Chen et al.

[11] Patent Number: 5,301,991

[45] Date of Patent: Apr. 12, 1994

[54] TENNIS BALL RETRIEVER AND STORAGE CART

[76] Inventors: Sam H. Chen, 13947 Carriage Rd.; Shunder Chang, 12655 Danielson Ct., #310, both of Poway, Calif. 92064; East White, No. 14 San-S. St., Taichung, Taiwan

[21] Appl. No.: 884,940

[22] Filed: May 18, 1992

[51] Int. Cl.[5] ..... A63B 47/02; B62B 3/02

[52] U.S. Cl. ..... 294/19.2; 248/132; 280/47.34

[58] Field of Search ..... 294/19.2; 414/439, 440, 414/441; 280/47.34, 47.35, 47.36; 273/29 R, 29 A, 32 D; 248/128, 129, 132; 56/328.1

[56] References Cited

U.S. PATENT DOCUMENTS

| | | | |
|---|---|---|---|
| 2,788,630 | 4/1957 | Nisbet | 294/19.2 X |
| 3,115,740 | 12/1963 | Hartley et al. | 294/19.2 X |
| 3,371,950 | 8/1966 | Stap | 294/15 |
| 3,902,749 | 9/1975 | Falitz | 294/19.2 |
| 3,926,465 | 12/1975 | Hoagland et al. | 294/15 |
| 4,184,707 | 1/1980 | Nelson et al. | 294/19 A |
| 4,193,625 | 3/1980 | Nelson | 294/19 A |
| 4,461,504 | 7/1984 | Perez et al. | 274/19 A |
| 4,643,317 | 2/1987 | Wilkinson et al. | 211/14 |
| 4,790,549 | 12/1988 | Armand | 280/47.35 X |
| 4,811,980 | 3/1989 | Ferrari et al. | 294/19.2 |
| 4,844,527 | 7/1989 | Ray | 294/19.2 |

FOREIGN PATENT DOCUMENTS

| | | | |
|---|---|---|---|
| 2410489 | 8/1979 | France | 294/19.2 |
| 2481128 | 10/1981 | France | 294/19.2 |
| 7901620 | 9/1980 | Netherlands | 294/19.2 |

*Primary Examiner*—Dean J. Kramer
*Attorney, Agent, or Firm*—Calif Kip Tervo

[57] ABSTRACT

A ball retrieving and storage cart generally comprises a wheeled carriage that rollingly supports a basket in a ball retrieving position. In an exemplary embodiment, the basket has a front end and a rear end and includes a bottom wall having two side members oriented front to rear and having a normal position spaced apart less than the ball diameter and defining a slotted aperture for entrance of a ball into the basket. In the ball retrieval position, at least one of the side members is a slanted member having a front end higher from the ground than a ball radius and a rear end lower to the ground than the ball radius. At least one of the side members is a deflectable member and is biased to the normal position but is sideways deflectable such that a ball on the ground entering the aperture sideways deflects the deflectable member sufficiently for the ball to pass into the basket. The wheels may define a rolling plane. The carriage includes a vertical frame member terminating in a push handle and the vertical frame member includes brackets for attaching a moveable basket at a serving position higher that is than the ball retrieving position.

5 Claims, 5 Drawing Sheets

TENNIS BALL RETRIEVER AND STORAGE CART

BACKGROUND OF THE INVENTION

1. Field of the Invention

This invention relates to a cart for retrieving and storing tennis balls and more specifically involves a push cart that supports a basket in a ball retrieving position.

2. Description of the Related Art

There has been a need for a device for collecting balls, such as tennis balls, from the ground without stooping over to pick them up. For example, U.S. Pat. No. 3,371,950 of Stap describes a tennis ball retriever and storage device comprising a basket having a top handle and a bottom of rods spaced apart a little less than a ball width. The basket is placed on a ball on the ground and the ball deforms to pass through the bottom rods. U.S. Pat. No. 3,926,465 of Hoagland describes a similar device except the bottom rods are hinged to allow a ball to enter without deformation. U.S. Pat. No. 4,461,504 of Perez describes a similar basket except the rods have roller sleeves over them to reduce friction of the ball passing.

The prior art devices all suffer a serious shortcoming in that a person must pick up or otherwise manipulate the basket in order to retrieve balls from the ground. This manipulation is time consuming and very fatiguing as the basket fills with balls.

Therefore, there has been a need for a ball retrieving and storage device that can simply be wheeled around such that the user need not lift or manipulate a basket for retrieval of each ball.

It is further desirable that such a device not require deformation of a retrieved ball.

It is further desirable is such a device provide for positioning of retrieved ball for serving.

SUMMARY OF THE INVENTION

This invention is a ball retrieving and storage cart and it generally comprises a wheeled carriage that rollingly supports a basket in a ball retrieving position.

In an exemplary embodiment, the basket has a front end and a rear end and includes a bottom wall having two side members oriented front to rear and having a normal position spaced apart less than the ball diameter and defining a slotted aperture for entrance of a ball into the basket. In the ball retrieval position, at least one of the side members is a slanted member having a front end higher from the ground than a ball radius and a rear end lower to the ground than the ball radius, and at least one of the side members is a deflectable member and is biased to the normal position but is sideways deflectable such that a ball on the ground entering the aperture sideways deflects the deflectable member sufficiently for the ball to pass into the basket. The wheels may define a rolling plane.

The carriage includes a vertical frame member terminating in a push handle and the vertical frame member includes brackets for attaching a moveable basket at a serving position that is higher than the ball retrieving position.

In the preferred embodiment the side members are rods describing arcs with a ball entry point about mid-span.

In an alternate embodiment, the side members are elastic.

In a third embodiment, the side members are rods mounted in V-shaped brackets that support the rods such that they may move upward and outward in response to encountering the horizontal diameter of a ball on the ground.

In a fourth embodiment, the basket bottom is configured so as to be in ball retrieval position when supported by only two wheels.

In a fifth embodiment, the cart handle is movable so as to support the basket in the serving position.

Other features and many attendant advantages of the invention will become more apparent upon a reading of the following detailed description together with the drawings in which like reference numerals refer to like parts throughout.

DETAILED DESCRIPTION OF THE INVENTION

Figure 1:
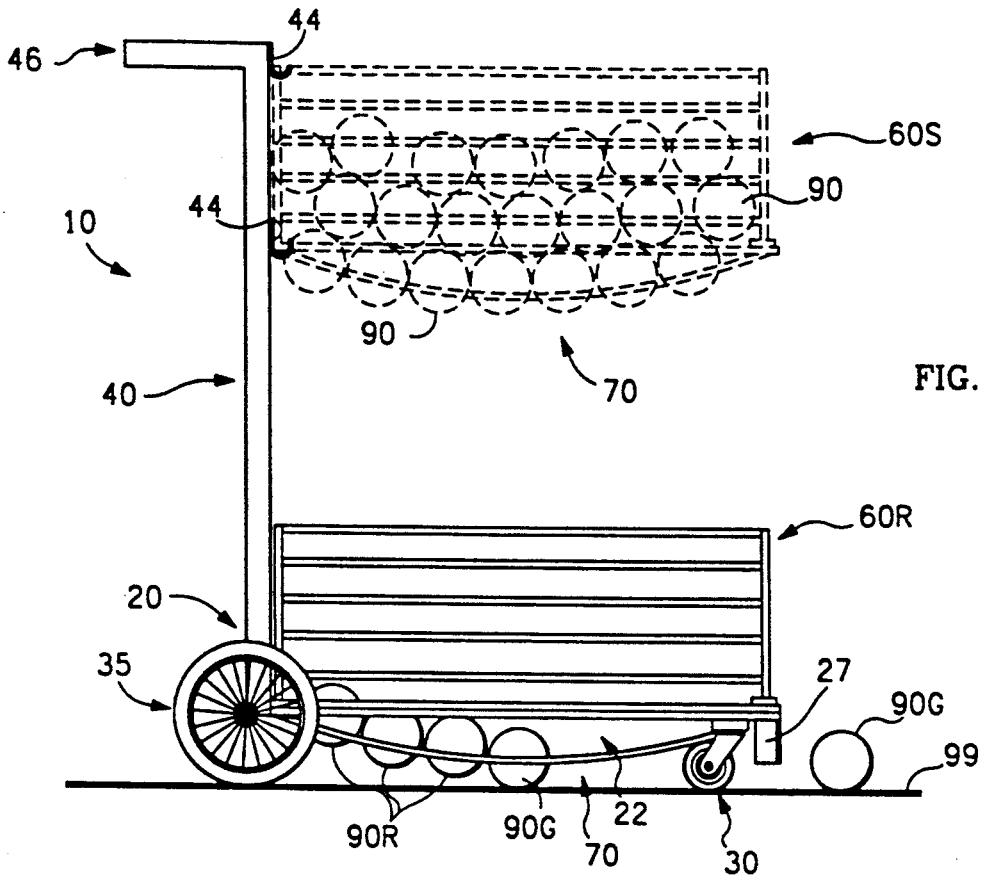
FIG. 1 is a side elevation view of a preferred embodiment of the tennis ball retriever and storage cart of the present invention.

With reference now to the drawings, and more particularly FIG. 1 thereof, there is shown a preferred embodiment of the ball retriever and storage cart, denoted generally as 10, of the present invention. Cart 10 is designed to pick up balls from off ground 99. Cart 10 generally comprises a carriage, denoted generally as 20, and a basket, denoted generally as 60. Ball 90G is on the ground and about to be retrieved. Balls 90R have already been retrieved and are inside basket 60R. Basket 60R shows the basket 60 in position for ball retrieval and basket 60S, in phantom, shows the basket 60 full of retrieved balls 90 and placed in position for serving.

Carriage 20 generally includes a frame, denoted generally as 22, a plurality of wheels rollingly supporting frame 22, including a pair of front wheels 30 and a pair of rear wheels 35, a standing frame 40 and a raised handle, denoted generally as 46.

Figure 2:
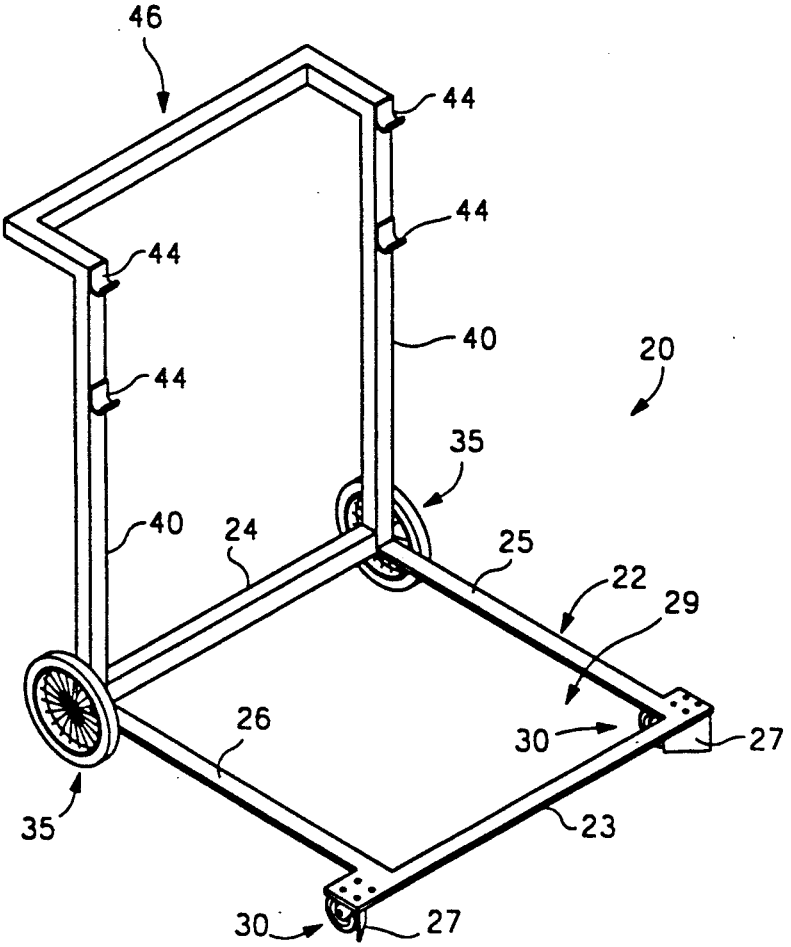
FIG. 2 is an elevated perspective view of the carriage portion of the cart of FIG. 1.

FIG. 2 is an elevated perspective view of the carriage 20 of the cart 10 of FIG. 1 and best illustrates the elements of carriage 20. Frame 22 is indeed a generally rectangular frame surrounding a inner opening 29 for insertion of basket 60. Frame 22 includes a pair of spaced apart, parallel front and rear transverse members, 23 and 24 respectively, and a pair of spaced apart, parallel spanning members 25,26 joining transverse members 23,24.

Frame 22 is rollingly supported by a plurality of wheels, front wheels 30 and rear wheels 35. The bottom of the wheels define a rolling plane for supporting a basket 60 at a specific height above the ground. Thus, although four wheels are shown, three wheels would be sufficient to define a plane and support basket 60 at a predetermined height. In the preferred embodiment shown, wheels 30,35 also support frame front 23 at a height such that it can pass over balls on the ground.

Front wheels 30, mounted to the front of frame 22, are fully castered so that carriage 20 is easily turned for picking up balls. Rear wheels 35 are rotatingly mounted to the rear of frame 22. Rear wheels 35 are larger than front wheels 30 and allow carriage 20 to be pulled rearward over rough terrain, such as up steps.

A ball deflector 27 is attached to frame 22 in front of each front wheel. Deflector 27 is a small plate directed downward from frame 22 and angled toward the ball pick up area in the center of carriage 20 to direct balls that are encountered into that area. Deflectors 27 permit cart 10 to pick up balls immediately adjacent a wall or fence. To this end, also, rear wheels 35 are in line with or have a narrower wheel base than front wheels 30.

A standing frame 40 is attached to the rear of frame 22. A handle 46 is connected to the upper end of standing frame 40. Frame 40 and handle 46 provide means for propelling carriage 20. Handle 46 is at a convenient height for a person to push, pull and steer cart 10.

Means, such as brackets 44, are disposed on the upper end of standing frame 40 for holding basket 60 in the serving position 60S.

Figure 3:
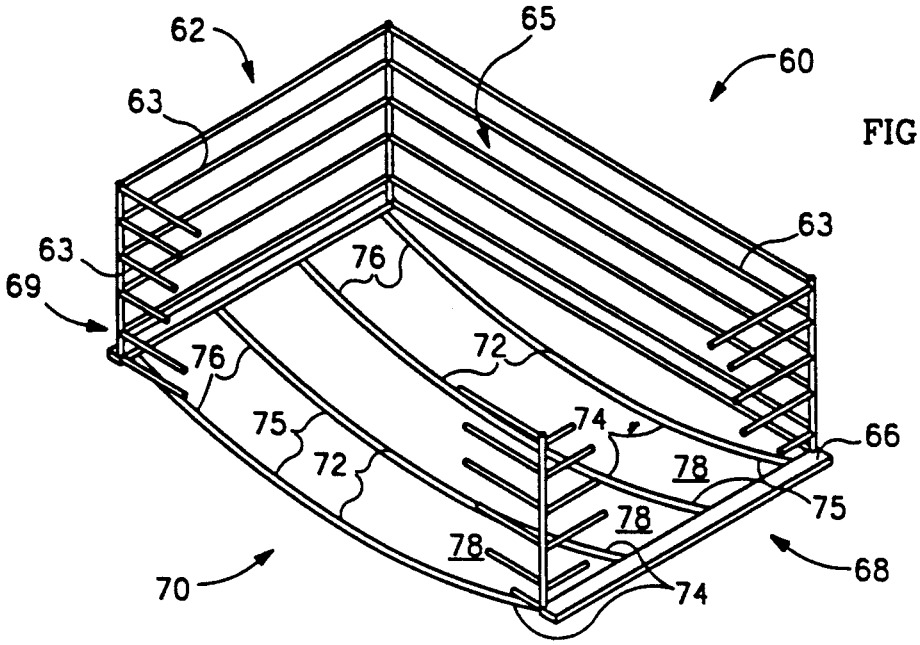
FIG. 3 is a partially cut away enlarged elevated perspective view of the basket portion of the cart of FIG. 1.
Figure 5:
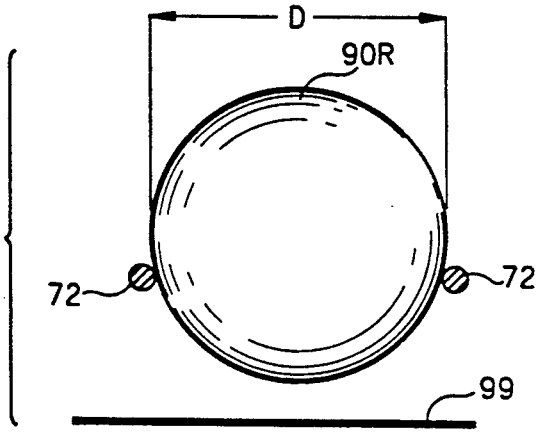
FIG. 5 is a front sectional view taken on line 5—5 of FIG. 4 of a ball retrieval aperture of the basket portion of FIG. 4.
Figure 4:
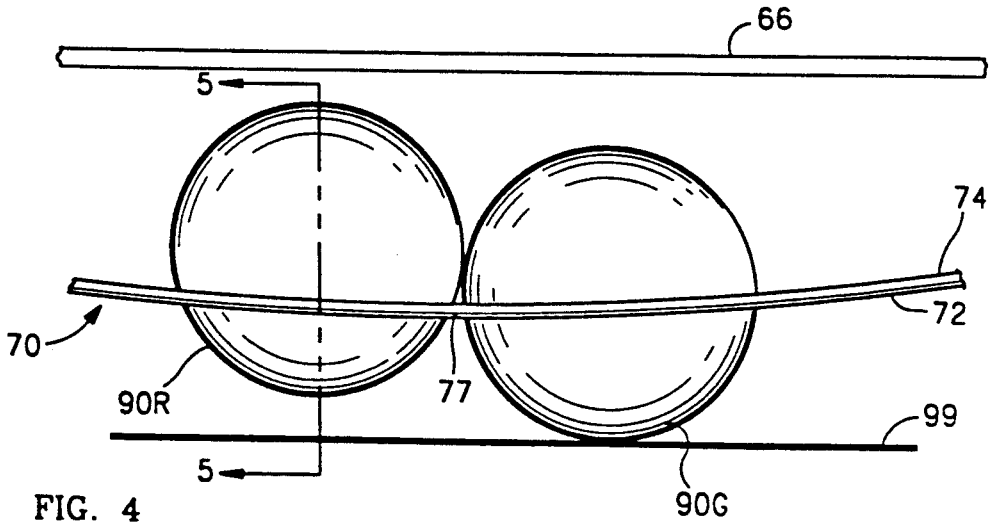
FIG. 4 is an enlarged side elevation view of a ball retrieval member of the basket portion of FIG. 1.

FIGS. 3, 4 and 5 illustrate the operation of the preferred embodiment of basket 60. FIG. 3 is a partially cut away enlarged elevated perspective view of basket 60 of the cart 10 of FIG. 1. FIG. 4 is an enlarged side elevation view of a ball retrieval member 72 of the basket 60 of FIG. 3. FIG. 5 is a front sectional view taken on line 5—5 of FIG. 4, of a ball retrieval aperture 78 the basket 60 of FIG. 3.

Starting with FIG. 3, basket 60 is designed to retrieve and store balls. Basket 60 is essentially a container for holding balls and includes upright walls 62 and bottom wall 70 surrounding a storage area 65. Basket 60 has a front 68 and a rear 69. Walls 62 can be made of any suitable material, but are preferably made of metal rods 63 spaced apart so as to contain balls. Many rods 63 are shown partially cut away to better show bottom 70. Rods 63 provide a light weight container. A support frame 66 is configured to mate with carriage frame 22 such that basket 60 is supported by carriage frame 22 when bottom wall 70 is inserted into carriage inner opening 29.

Basket bottom wall 70 serves to both retain balls in the basket and to retrieve balls from the ground. Bottom wall 70 includes a plurality of spaced apart, front to rear oriented side members 72, such as metal rods. Side members 72 are biased to have a normal spacing between them of less than a ball diameter defining a slotted aperture 78 for entrance of a ball into basket 60. Side members 72 have a front end 74, a middle section 75 and a rear end 76. As best seen in side view in FIG. 1, basket 60R, in the retrieval position supported by frame 22, has bottom wall side members 72 extending below support frame 66 down through the frame inner opening 29 to a position near the ground 99 for encountering a ball for retrieval. In the preferred embodiment, side members 72 are arc shaped with their lowest point being in mid-span.

FIGS. 4 and 5 illustrate the ball retrieval elements. FIG. 5 shows a retrieved ball 90R of diameter D. Turning to FIG. 4, Balls 90 are shown being retrieved. Basket frame 66 is supported by carriage frame 22 front cross member 23. Bottom wall 70 includes side member 72 that has a front end 74 higher than a ball radius above the ground 99. From front end 74 side member 72 slants downward rearward to a lower portion 77 closer to the ground than a ball radius. As cart 10 is wheeled over ball 90G on the ground 99, ball 90G enters ball retrieval aperture 78 between two side members 72. Ball 90G encounters the slanted portion of each side member 72 of aperture 78 and, as cart 10 rolls forward, the horizontal diameter D of ball 90G deflects side members 72 sideways such that the ball horizontal diameter D passes between them 72. Once the horizontal diameter D of ball 90G passes between side members 72, side members 72 spring back under the ball horizontal diameter D to their normal spacing position whereby ball 90R is retained in basket 60. In the preferred embodiment, the deflection point is near mid-span of side members 72 and, preferably, the angle of slant is less than ten degrees so as to produce the desired forces upon ball encounter. At mid-span, the sideward force necessary for deflection is minimized. FIG. 5 is a sectional view on line 5—5 of FIG. 4 showing ball 90R in the retained position within basket 60. Once side members 72 return to normal position, retained ball 90R is held in basket 60 off ground 99. Side members 72 are sufficiently stiff, i.e. biased to the normal position less than a ball diameter apart, that the mere weight of retained balls does not force the members 72 apart.

Returning momentarily to FIGS. 1 and 2, once sufficient balls have been retrieved, basket 60 is lifted from the retrieval position 60R and placed in the serving position 60S by hooking it to brackets 44 on standing frame 40. With basket 60S in serving position, balls 90R can be easily and quickly removed for serving.

Figure 6:
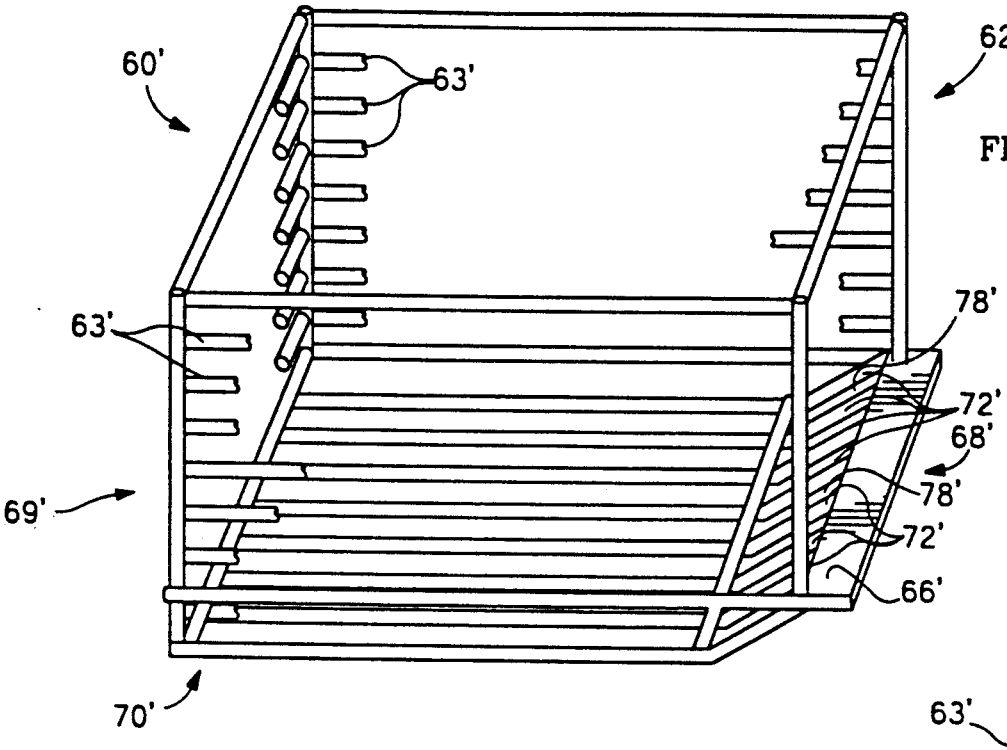
FIG. 6 is a perspective view of an alternate preferred embodiment of the basket portion.

FIG. 6 is a perspective view of an alternate preferred embodiment of the basket portion, denoted generally as 60'. Basket 60' is similar to basket 60 except for the construction of bottom wall 70'. The ball retrieval members are on the front of bottom wall 70' and include a plurality of spaced apart, front to rear oriented side members 72', such as elastic bands, such as bungee cords. Side members 72' are biased to have a normal spacing between them of less than a ball diameter defining a slotted aperture 78' for entrance of a ball 90 into basket 60'.

Figure 7:
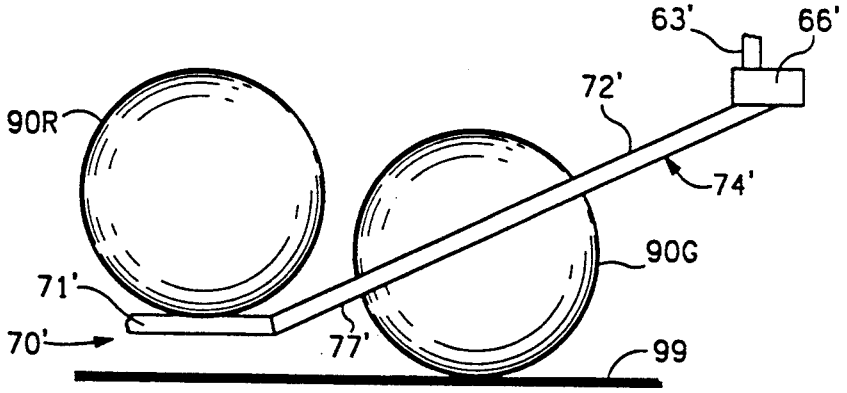
FIG. 7 is an enlarged side elevation view of a ball retrieval member of the basket of FIG. 6.

FIG. 7 better illustrates the ball retrieval elements. FIG. 7 is an enlarged side elevation view of the ball retrieval side members 72' of basket 60' of FIG. 6. FIG. 7 shows a retrieved ball 90R of diameter D. Ball 90G is about to be retrieved. Basket frame 66' is supported by carriage frame 22 front cross member 23. Bottom wall 70' includes a low portion 71' and includes elastic side member 72' that has a front end 74' higher than a ball radius above the ground 99. From front end 74' side member 72' slants downward rearward to a lower portion 77' closer to the ground than a ball radius. As cart 10 is wheeled over ball 90G on the ground 99, ball 90G enters ball retrieval aperture 78' between two side members 72'. Ball 90G encounters the slanted portion of each side member 72' of aperture 78' and, as cart 10 rolls forward, the horizontal diameter D of ball 90G deflects side members 72' sideways such that the ball horizontal diameter D passes between them 72'. Once the horizontal diameter D of ball 90G passes between side members 72', side members 72' spring back under the ball horizontal diameter D to their normal spacing position whereby ball 90R is retained in basket 60'. Bottom wall low portion 71' may be fine mesh or even solid so as to hold ball 90R off ground 99.

Figure 8:
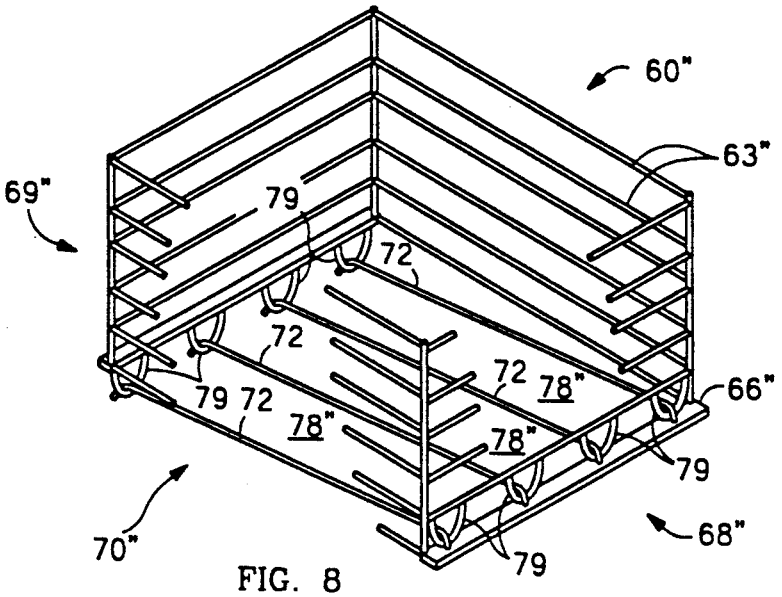
FIG. 8 is a perspective view of still another alternate embodiment of the basket portion.

FIG. 8 is a perspective view of still another alternate embodiment of the basket portion of the invention, denoted generally as 60". Basket 60" is similar to baskets 60 and 60' except for the ball retrieval components. In basket 60", side members 72" are rods that slant downward front 68" to rear 69" such that, with basket 60" in retrieving position, side members 72" have a front end higher than a ball radius and a rear end lower than a ball radius. Biasing means, such as gravity or a spring, biases side members 72" in the normal position, i.e. less than a ball diameter apart. A ball 90 to be retrieved enters an aperture 78" and, upon encountering side members 72", pushes up and apart on them 72". Side members 72" are supported on their ends by gravity guide means, such as V-shaped guides 79, for allowing side members 72" to move upward and outward in response to encountering the horizontal diameter of a ball 90. Once side members 72" have spread enough for ball horizontal diameter to pass, gravity will return them to the normal position whereby ball 90 is retained in basket 60".

Figure 9:
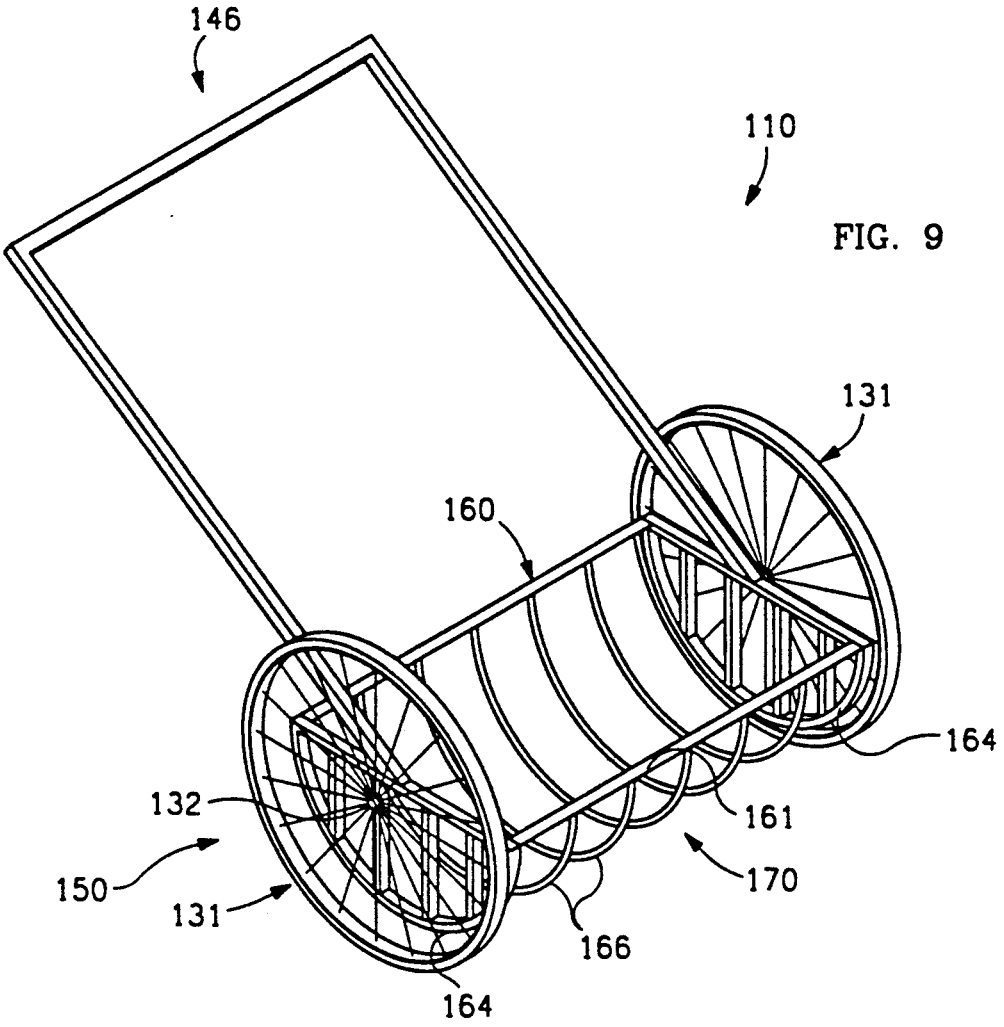
FIG. 9 is a front elevation perspective view of an alternate embodiment of the cart.
Figure 10:
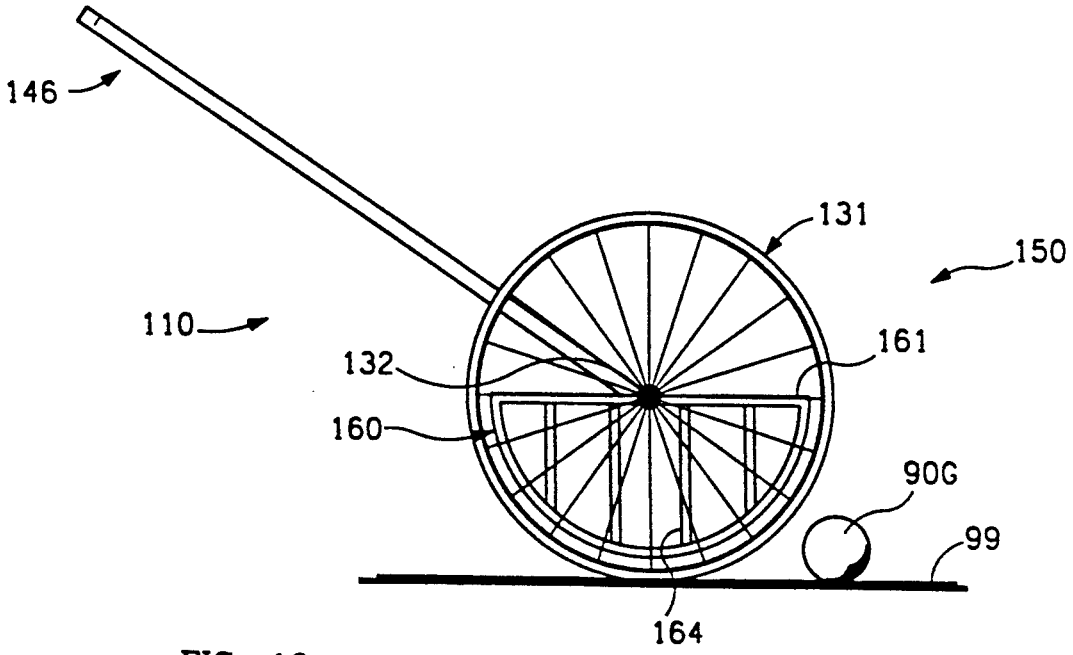
FIG. 10 is a side elevation view of the cart of FIG. 9.

FIG. 9 is a front elevation perspective view of an alternate embodiment of a cart, denoted generally as 110. FIG. 10 is a side elevation view of the cart 110 of FIG. 9. Cart 110 generally comprises a handle 146 connected to a wheeled basket, denoted generally as 150. Wheeled basket 150 includes basket 160 and a pair of wheels, generally denoted as 131. Wheels 131 preferably are co-axial and are rotationally attached to basket 160 in any manner, such as axles 132, well know in the art to rollingly support basket 160 in a ball retrieval position. Basket 160 generally includes a rectangular top frame 161, end walls 164 and bottom wall 170. Additional walls may extend above top frame 161 if more storage volume is desired. In the embodiment shown, handle 146 is fixedly connected to basket 160 such that as a user holds the handle end at various heights, basket 160 will rotate.

Bottom wall 170 is comprised of upwardly concave curved spaced apart metal rods 166 that function similarly to the rods 72 of the basket 60 of FIG. 3. Rods 166 are oriented front to rear and have a normal position spaced apart less than the ball diameter and define a slotted aperture for entrance of a ball 90G on the ground 99 into basket 160. Wheels 131 support basket 160 in the ball retrieval position wherein bottom wall rods 166 are slanted front to rear upon encountering a ball 90G and have a front end higher from the ground than the ball radius and a rear end lower to the ground than the ball radius. At least one rod 166 on the side of each aperture is sideways deflectable.

Preferably, bottom wall 170 has a radius of curvature slightly less than, ideally a little less than a ball radius, the radius of curvature of wheel 131 such that rods 166 are always in a ball retrieval position even if basket 160 is rotated due to a user holding handle 146 at a higher or lower position. Although, as shown, bottom wall rods are curved in a semi-circle, they typically need only be so curved in the bottom most 20–30 degrees to accommodate typical variations in handle position by a pusher. In this manner, a two wheeled cart 110 can maintain basket 160 in a ball retrieval position.

Figure 11:
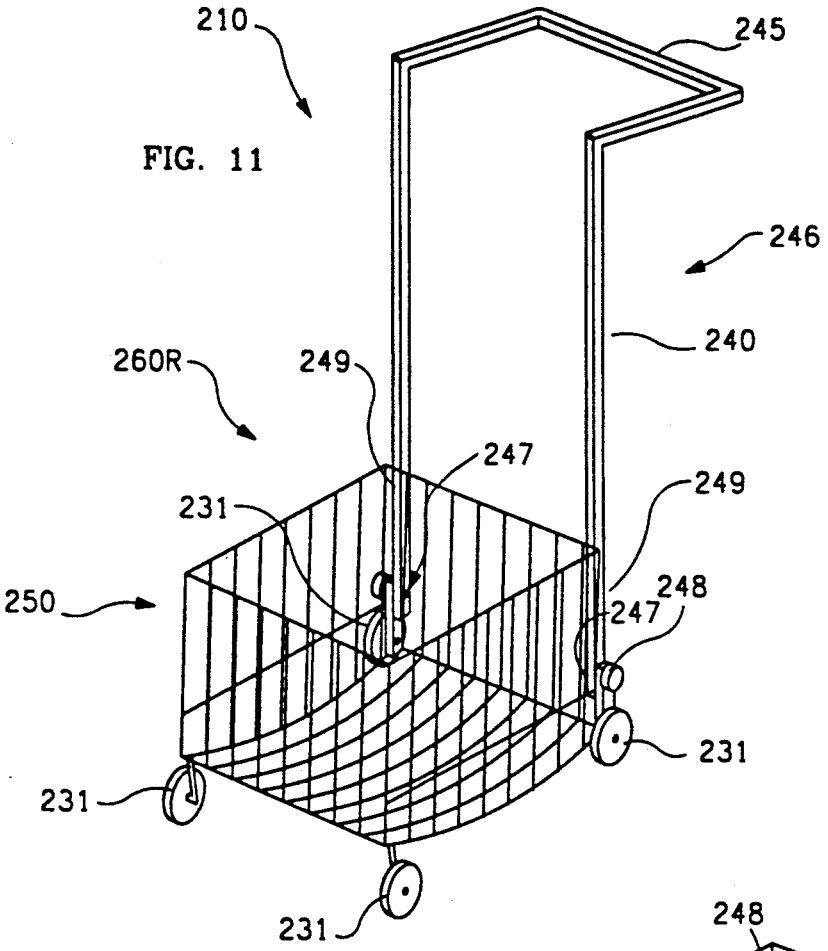
FIG. 11 is a front elevation perspective view of an alternate embodiment of the cart.
Figure 12:
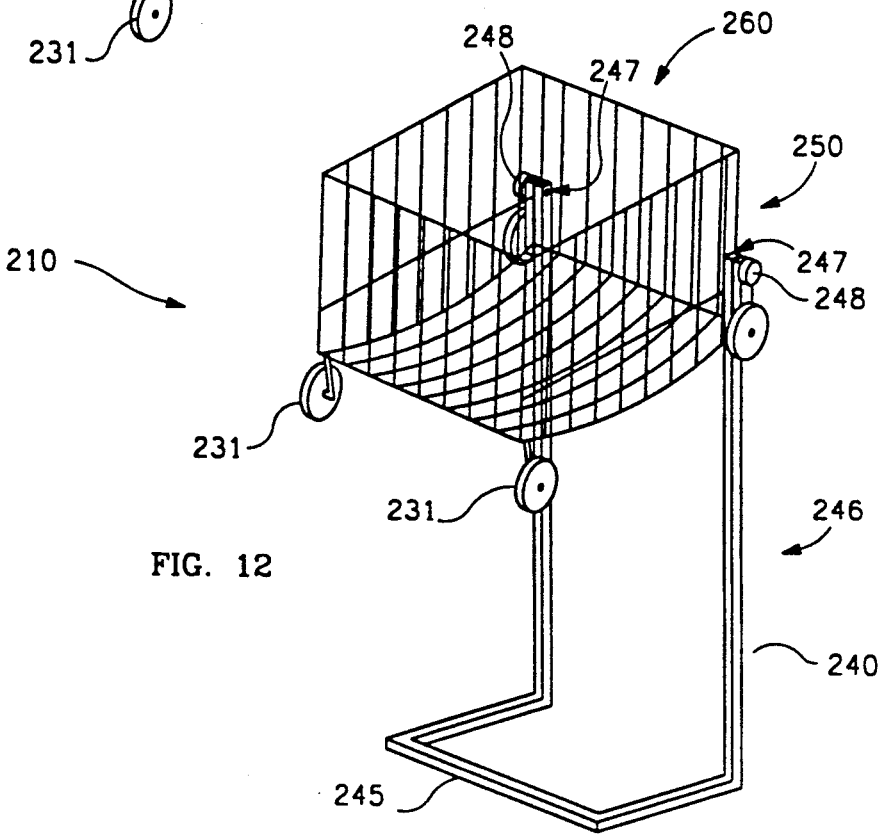
FIG. 12 is a front elevation perspective view of the cart of FIG. 11 in the service position.

FIG. 11 is a front elevation perspective view of the an alternate embodiment of the cart, denoted generally as 210. FIG. 12 is a front elevation perspective view of cart 210 of FIG. 11 in the service position. Cart 210 generally comprises a handle 246 connected to a wheeled basket 250. Wheeled basket 250 includes basket 260 and a set of wheels, generally denoted as 231. Wheels 231 are attached to basket 260 by any of means well known in the art such that they rollingly support basket 260 in a ball retrieval position 260R. Except as noted, basket 260 is similar to and functions generally the same as basket 60 having a slanted bottom.

Handle 246 includes a generally standing portion 240 and a top portion 245 connected to standing portion 240. Top portion 245 is substantially at a right angle rearward to standing portion 240. Handle 246 includes a lower end, such as ends 249, attached to the rear of wheeled basket 250 by hinge means such that handle 246 can be rotated to support basket 260 in the serving position as shown in FIG. 12. In the preferred embodiment, the hinge means includes pin hinge 247 having a locking means, such as tightening/release knob 248. Knob 248 is turned in a first direction to allow rotation of handle 246 about hinge 247 and is turned in second direction to prevent movement of handle 246 relative to basket 260. By releasing knob 248, handle 246 can be inverted as shown in FIG. 12 to support basket 260 in the serving position. Handle top portion 245 acts as a stable support platform.

Having described the invention, it can be seen that it provides a very convenient device for retrieving balls, such as tennis balls and for presenting them for serving.

Although a particular embodiment of the invention has been illustrated and described, various changes may be made in the form, composition, construction, and arrangement of the parts without sacrificing any of its advantages. Therefore, it is to be understood that all matter herein is to be interpreted and illustrative and not in any limiting sense and it is intended to cover in the appended claims such modifications as come within the true spirit and scope of the invention.

We claim:

1. A ball retrieval and storage cart for collecting a ball from the ground and inserting it into a basket; said cart comprising:

wheel means, including a plurality of wheels, for rollingly supporting a basket bottom wall in position for retrieval of a ball from the ground;

a basket rollingly supported in a ball retrieval position by said wheel means; said basket for retaining a plurality of balls therein; said basket having a front end and a rear end; said basket including:

a bottom wall including:

two side members oriented front to rear and having a normal position spaced apart less than the ball diameter and defining a slotted aperture for entrance of a ball into said basket; in the ball retrieval position:

at least one of said side members being a slanted member; said slanted member having a front end higher from the ground than the ball radius and a rear end lower to the ground than the ball radius;

at least one of said side members being a sideways deflectable member; said deflectable member being biased to the normal position but being sideways deflectable such that a ball on the ground entering said aperture sideways deflects said deflectable member sufficiently for the ball to pass into said basket; and wherein:

said deflectable member si a rod having a front end and a rear end; and said bottom wall includes a V-shaped guide supporting said rod front end such that said rod may move upward and outward in response to encountering the horizontal diameter of a ball on the ground.

2. The cart of claim 1 wherein:

both said side members are slanted.

3. The cart of claim 1 wherein:

both said side members are deflectable.

4. The cart of claim 1 wherein:

both said side members are slanted and deflectable.

5. A ball retrieval and storage cart for collecting a ball from the ground and inserting it into a basket; said cart comprising:

a wheel means, including a plurality of wheels, defining a rolling plane for rollingly supporting a basket bottom wall in position for retrieval of a ball from the ground;

a basket rollingly supported in a ball retrieval position by said wheel means; said basket for retaining a plurality of balls therein; said basket having a front end and a rear end; said basket including:

a bottom wall including:

two side members oriented front to rear and having a normal position spaced apart less than the ball diameter and defining a slotted aperture for entrance of a ball into said basket; in the ball retrieval position:

at least one of said side members being a slanted member; said slanted member having a front end higher from the ground than the ball radius and a rear end lower to the ground than the ball radius;

at least one of said side members being a sideways deflectable member; said deflectable member being biased to the normal position but being sideways deflectable such that a ball on the ground entering said aperture sideways deflects said deflectable member sufficiently for the ball to pass into said basket; and wherein:

said deflectable member is a rod having a front end and a rear end; and said bottom wall includes a V-shaped guide supporting said rod front end such that said rod may move upward and outward in response to encountering the horizontal diameter of a ball on the ground.

* * * * *